United States Patent [19]

Walser, Jr. et al.

[11] 4,019,208

[45] Apr. 26, 1977

[54] PANTY STOCKING AND COMBINATION PANTY HOSE GARMENT

[76] Inventors: Joseph G. Walser, Jr., P.O. Box 49, High Point, N.C. 27261; John O. Ferrell, Rte. 5, Box 122, High Point, N.C. 27263

[22] Filed: Apr. 7, 1975

[21] Appl. No.: 565,433

[52] U.S. Cl. ..... 2/240; 2/409

[51] Int. Cl.[2] ..... A41B 11/00

[58] Field of Search ..... 2/224 R, 227, 240, 239; 66/177; 128/519, 542, 548, 554

[56] References Cited

UNITED STATES PATENTS

| | | | |
|---|---|---|---|
| 2,826,760 | 3/1958 | Rice | 2/224 R |
| 3,386,270 | 6/1968 | Simmons | 2/240 |
| 3,440,665 | 4/1969 | Russell | 2/240 |

FOREIGN PATENTS OR APPLICATIONS

| | | | |
|---|---|---|---|
| 1,217,220 | 12/1970 | United Kingdom | 2/224 R |

*Primary Examiner*—H. Hampton Hunter

[57] ABSTRACT

A combination pantyhose garment in which separate seamless panty stockings are worn by the wearer in which each panty stocking is seamless knit of textured yarns and the panty portion is provided with a leg opening and a supporting band having elastomeric yarns which cross over each other in the overlapping panty portions to provide increased control characteristics in the garment.

8 Claims, 6 Drawing Figures

PANTY STOCKING AND COMBINATION PANTY HOSE GARMENT

BACKGROUND, OBJECTIVES AND BRIEF DESCRIPTION OF THE INVENTION

Substantial progress has been made in the pantyhose art since the issuance of U.S. Pat. No. 2,826,760 and in the various types and characteristics of textured yarns which include torque, set, edge-crimped, among other processes for imparting stretch and other characteristics. Additionally, various types of stockings and pantyhose having support or control characteristics have been developed of which the following are only representative: U.S. Pat. Nos. 3,362,029; 3,547,128; 3,566,624; and 3,720,078, among others. The introduction of spandex yarns, covered and uncovered, knit and laid-in, have also been widely used for improving the support or control characteristics in undergarments, hosiery and pantyhose.

Furthermore, considerable advances have been made in developing various types of "non-run" or run-resistant circular knit fabrics whether throughout the entire sheer portion of the foot and leg or in selected portions, such as in the toe or heel or welt to resist runs in the fabric.

One of the primary objections in the conventional one-piece pantyhose garment is that when one of the leg portions develops a run or other defect in wearing, the entire garment usually must be discarded. Some attempts have been made to resolve this problem by providing individual or separate panty stockings, of various types, which enable the wearer to discard one of the stocking units and replace it with another stocking unit while still retaining the stocking unit that is satisfactory. U.S. Pat. No. 3,547,128 demonstrates an approach to satisfy this problem, among others.

It is an objective of this invention to provide individual seamless panty stocking units which may be worn in combination to form a combination pantyhose garment in which one unit may be discarded and replaced by another unit while retaining one of the units that is still satisfactory thereby reducing the cost of replacing an entire garment.

Another objective of this invention is to provide a combination pantyhose garment in which a pair of separate seamless panty stockings is to be worn by the wearer in which there is a double panty portion which incorporates overlapping and crossing bands of supporting fabric to achieve increased control in the panty portion.

Yet another object of this invention is the provision of a combination pantyhose garment in which separate and interchangeable seamless panty stockings are combined to form a garment in which the leg portion is knit of stretchable yarns that are sheer in appearance and a panty portion that may be knit of other textured yarns that are denser or heavier denier and in which elastomeric yarns are provided in selected areas to provide added support in the panty portion of the garment.

Other objectives and many of the attendant advantages of this invention will become more readily apparent to those skilled in the knitting art including the provision of selected run-resistant areas upon consideration of the detailed description of the invention and the accompanying drawing.

DRAWING OF PREFERRED EMBODIMENT

DETAILED DESCRIPTION OF PREFERRED EMBODIMENT OF THE INVENTION

Figure 1:
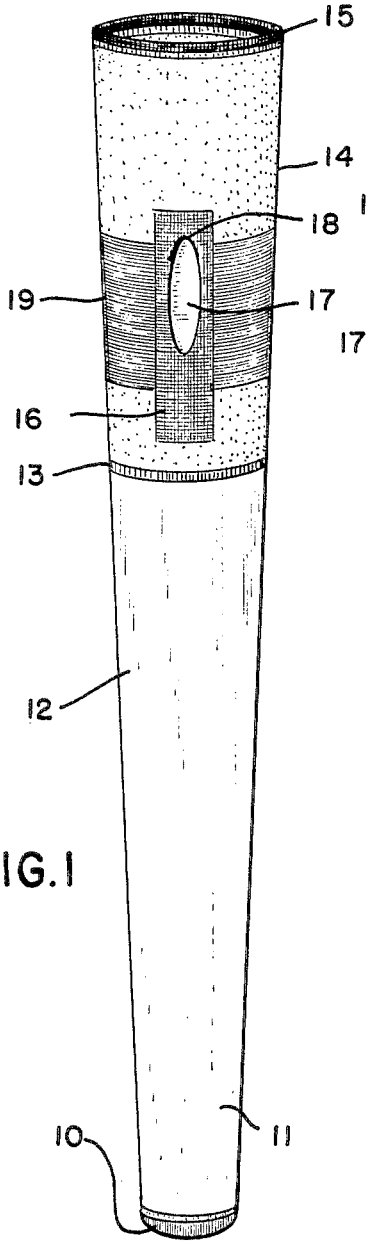
FIG. 1 is a front elevational view of an elongated seamless knit panty stocking embodying the features of this invention for a single stocking unit.

Referring to the drawing and particularly to FIG. 1, there is illustrated a single seamless panty stocking unit which is knit continuously on a circular knitting machine in which there are a toe portion 10, preferably with reinforced yarns and either a closure formed by an overedge seaming machine or by an automatic closure formed on the knitting machine, a foot portion 11, preferably formed without any heel reciprocation, a leg portion 12, having the same type yarns extending throughout as in the foot portion, and an after-welt portion 13, preferably utilizing a yarn of increased denier, and an abnormally elongated panty-welt portion 14, preferably knit with multifilament textured yarns that are more opaque than the sheer textured yarns used in the foot and leg portions, and a waist band 15, preferably integrally knit with the stocking blank or unit in which spandex yarns may be either knit or laid-in in selected courses or a separate elastic band may be overedge seamed or attached suitably.

The term "textured yarn" referred to herein is a yarn that has been processed to impart stretchable characteristics by any of the known texturing processes whether by false twist, edge-crimp, twist-heat, set-untwist, among other processes, to achieve the desired stretch and fit characteristics in the knitted stocking unit. It may be desirable to retain maximum stretch characteristics by omitting conventional boarding, if desirable.

There is provided in the panty-welt portion a substantially rectangular section 16 in which a "non-run" fabric is knit of known construction integrally with and simultaneously with the other portion of the welt. If desirable, the "non-run" or run-resistant portion 16 may incorporate an additional reinforcing yarn. The vertical or walewise extent of the section 16 will vary depending upon the size of the stocking unit, and the width may vary from one half inch to two inches or more in order to accommodate the leg opening 17 that is slit walewise within the section 16 to provide a leg opening in the panty-welt portion 14. Preferably, an overedge seam of other suitable stitching 18 may be provided at the upper end of the slit 17 as further assurance against raveling or runs occurring in the leg portion in the event the leg opening 17 must be enlarged depending upon the girth of the wearer's thigh.

Although it has been determined that most textured yarns provide a degree of control or support in the pantyhose portion of a pantyhose garment, the addition of an elastomeric yarn, such as spandex, provides substantially increased control or support characteristics and may eliminate the necessity for wearing other or additional control or support garments. It has been found desirable to provide, when additional support characteristics are desired, a supporting band 19 in the panty-welt portion 14 that extends from two inches to approximately six inches or more, depending upon the particular size panty stocking unit and the requirements of the wearer. Spandex yarns are preferably laid-in in selected courses in the supporting band 19. Depending upon the degree of control desired, or compressive force, the spandex yarns, whether covered or uncovered, may vary in denier depending upon the power desired, and be placed in every course, alternating courses or in every fourth course. In some instances, the spandex yarn may be knit instead of laid-in depending upon the desired fabric and support characteristics which may be preferred.

Figure 6:
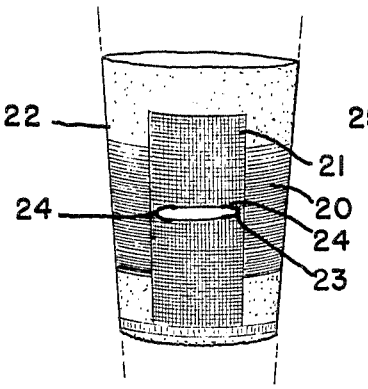
FIG. 6 is a partial side elevational view of a modified partial welt portion illustrating another type of leg opening.

An alternate embodiment of the supporting band 20 and the run-resistant section 21 is shown in FIG. 6 in the portion of the panty-welt 22 illustrated, and in which the leg opening 23 is slit horizontally with the terminal portions 24 being suitably stitched to prevent accidental enlargement. It will be readily apparent that in the event the leg openings 17 or 23 may be inadequate, the intended wearer need only elongate the opening either with scissors, knife, or blade within the run-resistant section.

Figure 2:
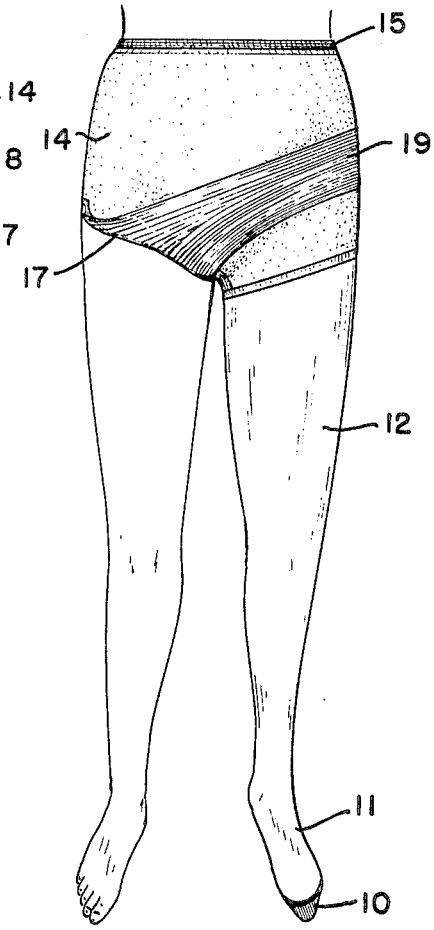
FIG. 2 is a front perspective view of the lower torso from the waist down on which the panty stocking of FIG. 1 is placed on the leg and lower torso of the wearer.
Figure 3:
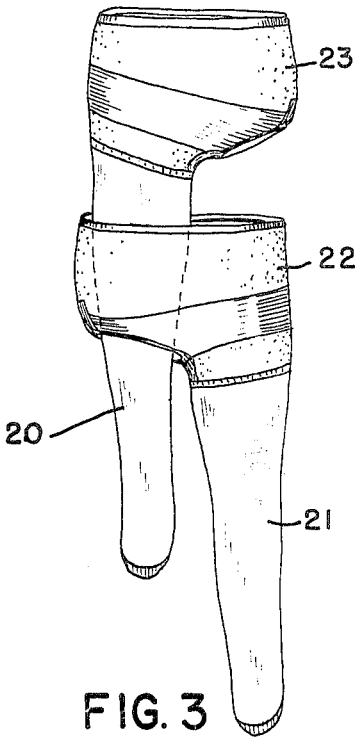
FIG. 3 is a side elevational and schematic view of a first stocking unit through which a second stocking unit is passed to illustrate the interrelationship between the two units.

The wearer, in placing one of the stocking units on to be worn, will insert one leg in a stocking unit in the normal fashion for placing a stocking on the leg and then place the other foot through the leg opening 17 in the panty-welt portion 14 before placing the panty portion of the stocking unit over the lower torso and position it in place so that the waist band 15 will extend around the waist of the wearer. As shown in FIG. 2, the supporting band 19 extends diagonally across the lower portion of the abdomen of the wearer. A similar or mating panty stocking unit is then placed on the other leg of the wearer and the covered leg of the first stocking unit is then placed through the leg opening 17 in the second panty stocking unit as shown in FIG. 3, after it has been placed in position on the leg of the wearer. For example, in FIG. 3, the first panty stocking unit 20 is positioned on the leg of the wearer and on the lower torso also. Thereafter, the second panty stocking unit 21 is placed on the other leg of the wearer and then the panty portion 22 is positioned over the panty portion 23 of the first unit 20 and both panty portions then may be adjusted in position.

Figure 4:
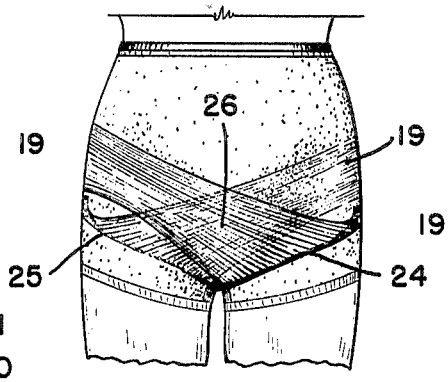
FIG. 4 is a partial front elevational view of the panty portion of the combination pantyhose garment consisting of two units positioned on the lower torso or panty portion of the wearer.
Figure 5:
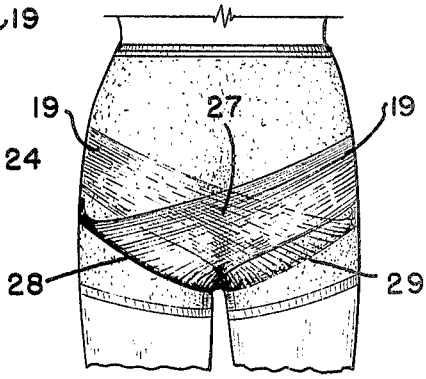
FIG. 5 is a rear elevational view of FIG. 4 with the garment on the wearer illustrating the crossover of the supporting bands in the overlapping panty portions of the stocking units.

As shown in FIG. 4, the two panty stocking units are positioned in place and illustrate the crossover supporting bands 19 that extend from the lower panty portion 24 of one unit to an intermediate portion of the panty, in one direction, and the other panty stocking unit supporting band 25 extends upwardly in the other direction, crossing over or under, the first position panty portion and providing an overlapping reinforced area 26 to provide increased control and support. As stated above, the extent of support and coverage will depend upon the width of the supporting band 19 in the panty portion of the garment. The rear of the garment in position is shown in FIG. 5 wherein the supporting bands 19 cross each other and form a rear reinforcing section of double fabric in the geometrical pattern 27. The lower portions of the reinforcing band in the rear of the garment, on the lower torso of the wearer, commences along the line 28 for one unit and line 29 for the other.

It will be readily apparent that should one of the panty stocking units become unusable, for any reason, one need only replace the unusable panty stocking unit while still being able to use the one that has not been damaged thereby eliminating the necessity for purchasing a full and complete unitary pantyhose garment.

It will be further readily apparent that the deniers of the various textured yarns may vary depending upon the ultimate characteristics that are desired for the garment and it is also contemplated that selective portions of the leg and foot may be provided with elastomeric yarns for increased support characteristics.

We claim:

1. An elongated seamless panty stocking having toe, foot, and leg portions, and an abnormally elongated welt forming a panty portion and having an elastic supporting band intermediate said welt portion and a top band, said welt portion having a leg opening therein intermediate the length of said welt whereby upon placing the panty stocking on the wearer, the supporting band extends around the front and back of the wearer to provide increased control or support in the panty portion.

2. An elongated seamless knit panty stocking as claimed in claim 1, at least said foot, leg and welt portions being knit of textured yarns.

3. An elongated seamless knit panty stocking as claimed in claim 1, said elongated welt having at least a section surrounding said leg opening having run-resistant fabric.

4. An elongated seamless knit panty stocking as claimed in claim 1, said elongated welt having an integrally knit circumferential supporting elastic band in the panty portion.

5. An elongated seamless knit panty stocking as claimed in claim 4, said integrally knit circumferential supporting elastic band in the panty portion having a series of courses incorporating elastomeric yarn.

6. An elongated seamless knit panty stocking as claimed in claim 1, said foot, leg and welt portions being knit of textured yarn, said elongated welt having a section of run-resistant fabric surrounding said leg opening, a supporting elastic band integrally knit in said elongated welt and extending circumferentially around said welt in the panty portion thereof, said elastic band having a series of courses including elastomeric yarn.

7. A combination pantyhose garment comprising two separate seamless panty stockings, each panty stocking having, toe, foot, leg and panty-welt portions knit of textured yarns, each panty stocking also having an elastic top band, the panty portion of each stocking having a leg opening in said welt portion intermediate the length thereof, a series of courses in said panty portion having elastomeric yarn forming a supporting intermediate band whereby upon placing the panty stocking on the wearer, the panty portions substantially overlap each other and the supporting bands cross over each other, front and back, to provide increased control or support in the panty portion.

8. A combination pantyhose garment as claimed in claim 7, a run-resistant knitted section integrally knit with said panty portion surrounding said leg opening.

* * * * *